US005509660A

United States Patent [19]

Elmer

[11] Patent Number: 5,509,660

[45] Date of Patent: Apr. 23, 1996

[54] GOLF CLUBS

[76] Inventor: John C. Elmer, 16 Patrick Duncan Road, Kloof, Kwa Zulu Natal, South Africa

[21] Appl. No.: 288,272

[22] Filed: Aug. 8, 1994

[30] Foreign Application Priority Data

Aug. 17, 1993 [ZA] South Africa ..... 93/6012

[51] Int. Cl.[6] ..... A63B 53/04

[52] U.S. Cl. ..... 473/288; 473/330; 473/342; 473/350

[58] Field of Search ..... 273/173, 174, 273/175, 169, 171, 172, 167 A, 167 F, 167 G, 167 H, 167 J, 167 K, 77 A, 78, 79

[56] References Cited

U.S. PATENT DOCUMENTS

| | | | |
|---|---|---|---|
| 3,190,651 | 6/1965 | Thomas | 273/79 |
| 3,692,306 | 9/1972 | Glover | 273/171 |
| 4,573,685 | 3/1986 | Young, IV et al. | 273/171 |
| 4,681,322 | 7/1987 | Straza et al. | 273/173 |
| 4,699,383 | 10/1987 | Kobayashi | 273/173 |
| 4,874,171 | 10/1989 | Ezaki et al. | 273/167 H |
| 4,883,275 | 11/1989 | Boone | 273/167 H |
| 4,884,812 | 12/1989 | Nagasaki et al. | 273/173 |
| 5,141,231 | 8/1992 | Cox | 273/173 |
| 5,176,384 | 1/1993 | Sato et al. | 273/173 |
| 5,303,922 | 4/1994 | Lo | 273/173 |

*Primary Examiner*—Vincent Millin
*Assistant Examiner*—Steven B. Wong
*Attorney, Agent, or Firm*—Ladas & Parry

[57] ABSTRACT

The invention relates to a golf club head which comprises a body made up of two body parts. The first body part comprises a body segment, defining the striking face of the golf club head, and a second body segment extending substantially perpendicularly from the first body segment and defining the sole of the golf club head. The second body part comprises a perimeter weighted frame which forms the rear side of the golf club head and a hosel for receiving a golf club shaft. The two body parts define complementary locating formations permitting the required location of the two body parts with respect to one another and securing together thereof by rivets.

21 Claims, 2 Drawing Sheets

GOLF CLUBS

Figure 1:
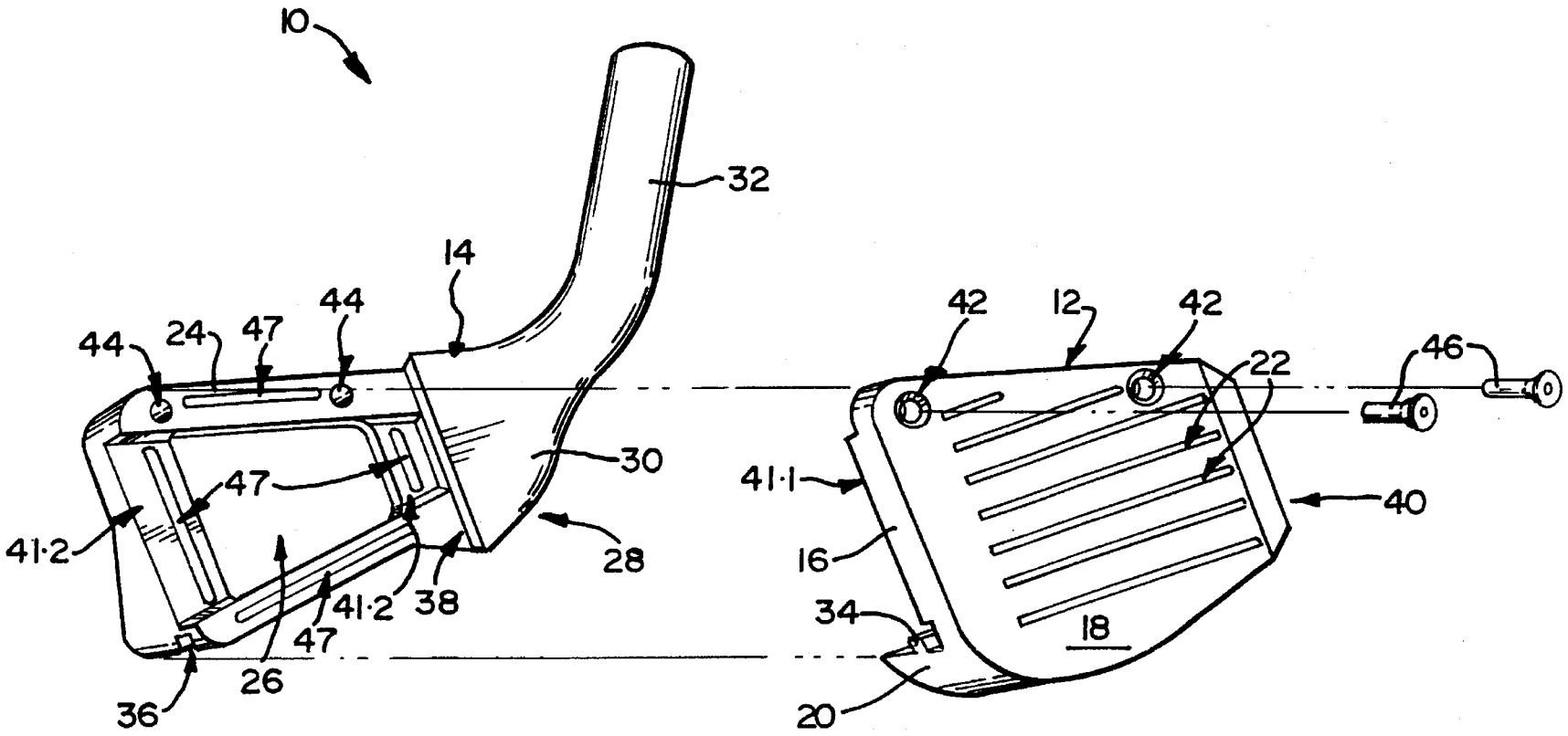

This invention relates to golf clubs. Particularly, the invention relates to a golf club head and to a golf club including such a head.

Known golf clubs generally are in the form of woods, irons, or putters, the general configurations of all three types of golf clubs being well known. The general configurations and the applications of these golf clubs are thus not defined or described in any further detail herein. The present invention relates particularly to golf clubs in the form of woods and irons only and any reference hereinafter to a golf club, therefore, must be interpreted as a reference to a golf club in the form of a wood or an iron, excluding specifically golf club putters in respect of which totally different design criteria and requirements apply.

A wood and an iron-type golf club each comprises a golf club head defining a bore or socket formation within which one end of an elongated shaft is secured, the shaft extending from the head and having a grip secured to the end thereof remote from the head, whereby the shaft can be gripped for the purpose of swinging the golf club head for striking a golf ball. The golf club head of a golf club conventionally comprises a body defining a substantially flat front face, or striking face, with the remainder of the body extending operatively rearwardly from the face and defining a bottom face known as the sole of the club head. The bore or socket formation for the shaft of the club usually is defined at one end of the club head, known as the heel of the club head, the club head thus extending away from the shaft in a desired angular configuration towards its opposite end, known as the toe of the club head, the striking face of the club head extending between the said heel and toe of the club head.

As the general configuration of golf clubs of the type described above is well known and as this does not form a specific part of the present invention, this is not described in any further detail herein. Also, any reference hereinafter to a golf club and to a golf club head must be interpreted as a reference to a golf club and to a golf club head of the above general type.

According to a first aspect of the invention there is provided a golf club head defining a striking face, a sole, a toe, a heel and a socket formation for receiving a golf club shaft, the golf club head comprising a first body part that includes a first body segment defining the striking face of the golf club head and a second body segment extending integrally from the first body segment and defining at least a part of the sole of the golf club head; and a second body part to which the first body part is secured and which has a socket formation for a golf club shaft to be secured to the golf club head.

The socket formation of the second body part is in the form of a hosel extending from the remainder of the body part, the hosel being formed to permit a conventional-type golf club shaft to be conventionally secured to the second body part.

Further according to the invention, for a golf club head which is specifically in the form of an iron-type golf club head, the second body part may comprise a frame against which the first body part is secured, the frame being similar in shape to the outer perimeter of the striking face defined by the first body part. The frame may define a central hole therethrough that is blocked-off by the first body part secured against the frame, the frame providing the golf club head with a central rear recess and resulting perimeter weighting operatively behind the striking face defined by the first body part.

Also for an iron-type golf club head, the first body part may define the striking face and the entire sole of the golf club head. Also, the first and second body parts may define complementary formations whereby the body parts are correctly located with respect to one another.

These complementary locating formations may include a rail formation and a complementary groove formation defined by the first body part and the second body part respectively, the rail formation being defined by the second body segment of the first body part in a region disposed operatively beneath the second body part, the complementary rail and groove formations extending between the heel and toe of the golf club head. Alternatively, or in addition, the heel end of the first body part may be profiled to cooperate with a cut-back formation on the second body part for locating the two body parts in their required configuration in the heel end of the golf club head. Still alternatively, or in addition, the frame and the first body part may define abutting faces and the abutting faces may define complementary formations whereby these faces are located with respect to one another.

Still further for a golf club head in the form of an iron-type golf club head, the first body segment of the first body part defining the striking face of the golf club head may be a substantially flat planar body segment and the second body segment defining the sole of the golf club head may extend substantially perpendicularly from the first body segment.

The golf club head in the form of an iron-type golf club head may include securing means which secure the first and second body parts together. The securing means may include at least one rivet and the first and second body parts may define aligned apertures therein in which the rivet is received. Alternatively, the securing means may include at least one locking screw and the first and second body parts may define aligned apertures in which the locking screw is received, the first and second body parts being secured together by the locking screw.

For a golf club head in the form of a wood-type golf club head, the second body part may comprise a hollow body and define a locating formation whereby the first body part is located with respect to the second body part. The hollow body may be foam filled and securing means may be provided whereby the first and second body parts are secured together. The securing means may include securing screws whereby the first and second body parts are secured together.

In general, for a golf club head, both in the form of an iron-type golf club head and a wood-type golf club head, an adhesive may be used between abutting faces of the first and second body parts for providing at least partially for the first and second body parts being secured together. As such, channel-shaped recesses may be defined in the abutting face of at least one of the first and second body parts, within which the adhesive is collected. The adhesive may be a silicone-type adhesive forming a resiliently compressible layer of material between the first and second body parts.

Furthermore, the striking face defined by the first body segment of the first body part may define a series of parallel grooves therein that are substantially horizontally disposed in the operative configuration of the golf club head for striking a golf ball. Alternatively, the first body segment of the first body part may have a recess formation defined therein which has a striking face insert securely located therein, the striking face insert defining the striking face of the golf club head and having the grooves defined therein.

The second body part of a golf club head, in accordance with the invention, may be of a conventional material associated with golf club heads, typically of stainless steel for an iron-type golf club head.

The first body part of a golf club head, in accordance with the invention, may be of a material that provides for predetermined striking characteristics of the golf club head. As such, the first body part may be formed of any one of the following range of materials: graphite, beryllium copper, aluminium bronze, forged steel, cast stainless steel, and a combination of these materials.

Further according to the invention, the golf club head may include a tapered shim located between the first and second body parts, the configuration of the shim determining the exact club face angle and the loft angle of the striking face of the golf club head.

From the above it will be appreciated that by providing a series or range of different first body parts of a golf club head, in accordance with the invention, and/or second body parts of a golf club head, in accordance with the invention, and/or shims and by using different combinations of these components, golf club heads can be provided with different desired qualities in order to accommodate the requirements of different individual golfers. Also, by the provision of the separate components it will become possible to alter the characteristics of golf club heads by the substitution of different components and it is envisaged particularly that all the above components can be provided in a kit form which will permit the assembly of different golf club heads as proposed.

As such, according to a second aspect of this invention, there is provided a kit for constructing a golf club having a golf club head defining a striking face, a sole, a toe, a heel, and a socket formation for receiving a golf club shaft, the kit including:

a first body part that includes a first body segment defining the striking face of a golf club head and a second body segment extending integrally from the first body segment and defining at least a part of the sole of the golf club head; and a second body part to which the first body part is securable and which has a socket formation for a golf club shaft to be secured to the golf club head.

The kit in accordance with the second aspect of this invention may provide particularly for constructing a golf club head in accordance with the first aspect of this invention. Also, the kit may include a shaft that is securable to the second body part. Still further, the kit may include securing means for securing the first and second body parts together.

The invention extends also to a first body part for a golf club head, in accordance with the first aspect of this invention, and to a second body part for a golf club head, in accordance with the first aspect of this invention.

Still further, this invention extends to a golf club which includes a golf club head, in accordance with the first aspect of this invention, and a shaft secured to the socket formation defined by the second body part of the golf club head.

Figure 2:
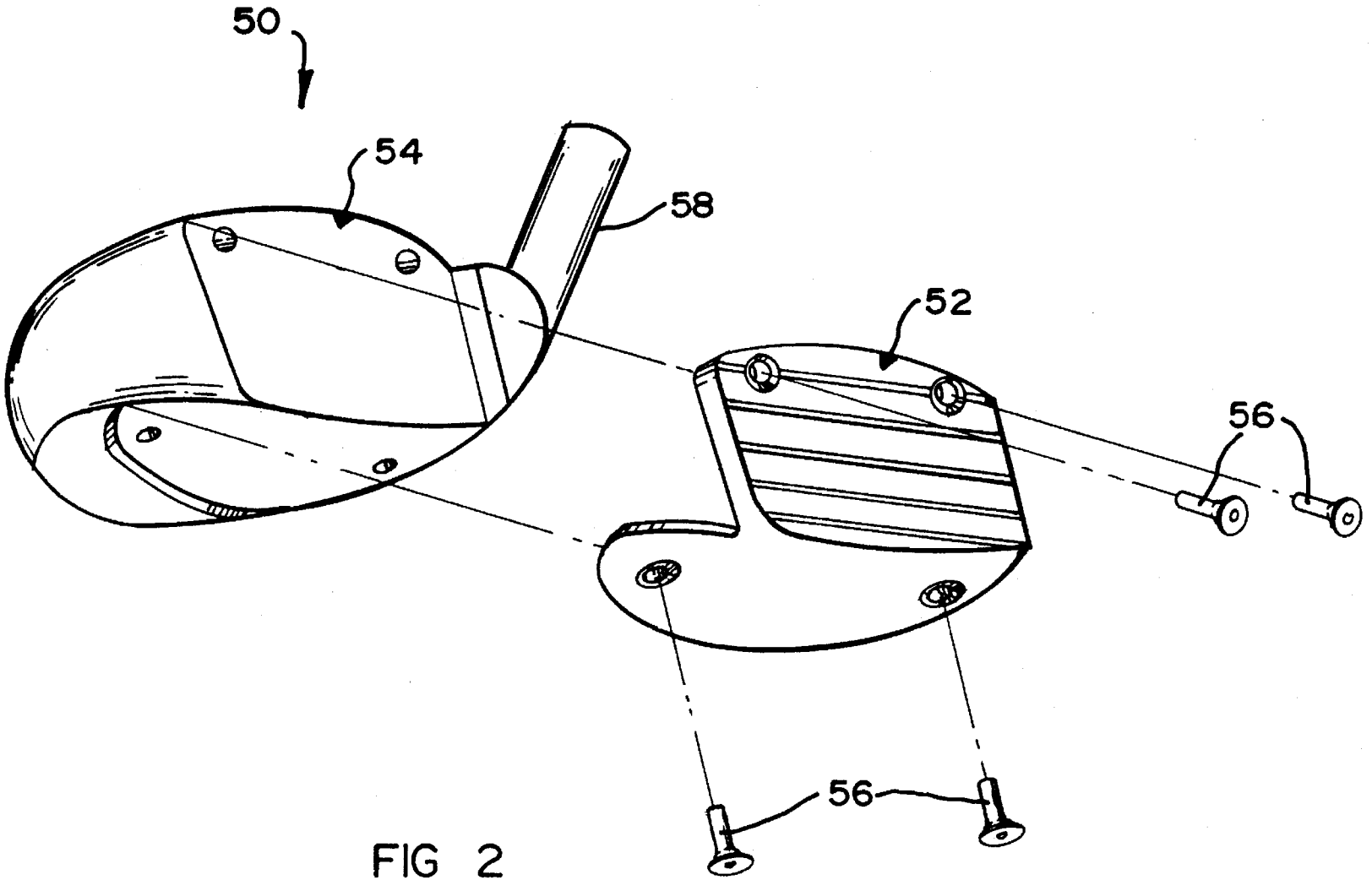

Further features of the invention including the benefits of the invention are described in more detail hereinafter with reference to two examples of the invention, illustrated by way of the accompanying diagrammatic drawings. In the drawings:

FIG. 1 shows a three-dimensional exploded view of an iron-type golf club head, in accordance with the invention; and FIG. 2 shows a three-dimensional exploded view of a wood-type golf club head, in accordance with the invention.

Referring initially to FIG. 1 of the drawings, an iron-type golf club head, in accordance with the invention, is designated generally by the reference numeral 10. The golf club head 10 comprises a body made up of a first body part 12 and a second body part 14, the two body parts being securable together to form the complete golf club head, in the manner described hereafter.

The first body part 12 comprises a first body segment 16 that defines an exposed front face 18 that is essentially planar and that defines the striking face of the club head 10. The body segment 16 has a second body segment 20 extending substantially perpendicularly therefrom, the body segment 20 extending operatively rearwardly from the striking face 18 and, in the operative configuration of the golf club head 10, defines the operative bottom face of the golf club head, known as the sole of the golf club head.

The striking face 18 of the body part 12 has a plurality of parallel, spaced grooves 22 formed therein, the grooves 22 being disposed to apply spin onto a golf ball struck by the golf club head 10, the configuration of the grooves 22 being equivalent to the grooves that are associated with known golf club heads.

The second body part 14 of the golf club head 10 comprises a perimeter weighted frame 24 which forms the operative rear side of the golf club head 10 in its operative configuration, the frame 24 defining a central aperture 26 therethrough. The aperture 26 is effectively blocked-off by the rear side of the first body part 12 when located in its operative configuration with respect to the second body part 14. In this operative configuration, the club head 10 thus defines a central rear recess which effectively provides for perimeter weighting of the golf club head in a configuration commonly associated with known golf club heads.

The frame 24, on the heel side 28 of the body part 14, defines an intermediate body portion 30 from which a hosel 32 extends, the hosel 32 being adapted to have the end of a golf club shaft secured therein in order to form a complete golf club, including the head 10. The general configuration of the hosel is essentially conventional as for known golf clubs.

In order to provide for the accurate location of the two body parts 12 and 14 with respect to one another, the body portion 20 of the first body part 12 defines a rail formation 34 that can cooperate with a groove 36 defined in the operative base part of the second body part 14, the two body parts thereby being slidably engageable with one another in an operative location as required. Also, on the heel side 28 of the frame 24, the intermediate portion 30 of the body part 14 defines an undercut formation 38 that can cooperate with a suitably shaped heel end 40 of the body part 12, in order to provide for the secure location of the two body parts with respect to one another.

Still further, the opposing faces of the first body 12 and the second body part 14 that abut one another, define complementary formations 41.1 and 41.2 respectively (one formation 41.1 of the body part 12 not being shown), these formations cooperating with one another to secure the location of the body parts 12 and 14 with respect to one another.

In this operative configuration as described, holes 42 in the first body part 12 will be aligned with holes 44 in the second body part 14, the holes being adapted to receive rivets 46 therein, whereby the two body parts 12 and 14 are releasably locked together in their operative configuration. A silicone-type adhesive also is used between the body parts 12 and 14 to secure them together, the adhesive collecting in channel-shaped recesses 47 in the body part 14 and forming a resiliently compressible layer of material between the two body parts. As such, by securing a suitable shaft to the combined head 10 via the hosel 32 and applying a suitable grip at the opposite free end of the shaft, a complete iron-type golf club is provided. Also, by the suitable design of the body parts forming a golf club head 10, provision is made for different golf club irons of a set to be assembled, which may typically include irons numbering from one to nine and including also suitable wedges.

It is envisaged that the second body part 14 of the club head 10 can be made of any conventional material commonly associated with iron-type golf clubs, whereas the first body part 12 can be made of any one of a selected group of materials in order to provide the golf club with different striking characteristics. For example, the first body part may be made of graphite, beryllium copper, aluminium bronze, forged steel, cast stainless steel, or a combination of any one or more of these materials.

It is also envisaged that first body parts having slightly different characteristics to provide, for example, slightly different club-face angles and loft angles can be provided, so that specific first body parts will be selected when assembling a club head in order to accommodate specific golfer requirements. In order to provide for further variation, it is envisaged that tapered shims can be provided for location between the first and second body parts, with taper angles providing for an adjustment of club face angles, loft angles, and the like. This will also facilitate the adjustment of these angles in relation to particular clubs in order to accommodate different playing conditions. Still further, the configuration of the first body part 12 may provide for different lies of the complete golf club head, thus providing for further selection and, as such, club head variation in order to accommodate particular golfers.

One further advantage of a golf club head as above defined, is that if the face or sole of a particular golf club head is damaged, it will not be necessary to purchase a completely new golf club, insofar as the first body part can then merely be replaced with a new body part having the exact same characteristics.

The principles of the golf club head 10 as described above, also can be similarly applied to the head of a wood-type golf club and FIG. 2 illustrates specifically a wood-type golf club head, in accordance with the invention, this golf club head being designated generally by the reference numeral 50. This golf club head 50 includes a first body part 52 that defines the striking face and a portion of the sole of the complete golf club head and a second body part 54 that defines the main body of the golf club head with specific recess-type locating formations that provide for the location of the first body part 52 with respect thereto. Locking screws 56 are provided for locking the first body with respect to the second body part in their operative configuration with respect to one another, it being envisaged further that the two body parts can define any further locating formations to provide for the accurate and secure location of the body parts with respect to one another. The second body part 54 again incorporates a hosel 58 for securing a shaft to the golf club head 50 and thus permitting a complete golf club to be formed. As the remaining principles of construction of the golf club head 50 is essentially equivalent to that of the golf club head 10, this is not described or defined in any further detail herein. Once again, by providing for different first body parts to be associated with a basic second body part, a golf club head having different striking characteristics can be provided for, it being envisaged further that the loft angle of the golf club head can be adjusted by utilizing slightly different first body parts 52.

In general, kits can be provided incorporating the components as above defined, which will enable the assembly of individual golf clubs or sets of golf clubs, the interchangeability of different components enabling various different requirements to be accommodated. Also, when the particular requirements of a golfer changes, it will not be necessary for a completely new set of golf clubs to be purchased, insofar as variations can be made by the substitution of individual components. Particularly, it is envisaged that the first body part forming part of the golf club head will be suitably interchangeable for this purpose. It is also possible to use softer materials for the first body part of a golf club head to those materials commonly used for golf club heads insofar as damage can be accommodated by merely having to replace the first body parts.

It is also envisaged that the first body part of a golf club head as described can have a recess in its front face in which a face insert (not shown) is received, the face insert again making it possible to use different materials for forming the striking face of the associated golf club head. Typically, the face insert is of a carbon material, a compressed fibre material, or the like.

The invention clearly extends also to complete golf clubs including golf club heads in accordance with the invention and as described above, as well as complete sets of golf clubs where individual golf clubs include such golf club heads. Still further, the invention extends to a kit including a plurality of individual components of a golf club head as described above and which facilitates the assembly of a complete golf club head for forming a golf club as envisaged herein.

I claim:

1. A golf club head for an iron-type golf club defining a striking face, a sole, a toe, a heel and a socket formation for receiving a golf club shaft, the golf club head comprising:

a first body part that includes a first body segment defining the striking face of the golf club head and a second body segment extending integrally from the first body segment and defining the sole of the golf club head;

a second body part removably located with respect to the first body part, the second body part including a frame, operatively located behind the first body segment of the first body part, the frame being perimeter weighted around a central region and providing perimeter weighting operatively behind the striking face defined by the first body segment of the first body part, and the socket formation of the golf club head extending integrally from the frame, the second body part being removably located with respect to the first body part by complementary locating formations defined by the first and second body parts respectively, the complementary locating formations permitting only displacement of the first body part with respect to the second body part along a line substantially parallel to the sole of the golf club head and in a direction away from the socket formation of the second body part; and securing means for releasably securing the first and second body parts together.

2. A golf club head as claimed in claim 29 in which the socket formation of the second body part is in the form of a hosel, the hosel being formed to permit a golf club shaft to be secured to the second body part.

3. A golf club head as claimed in claim 1, in which the central region of the frame defines a hole therethrough that is blocked-off by the first body part.

4. A golf club head as claimed in claim 1, in which the complementary locating formations include a rail formation and a complementary groove formation defined by the first body part and the second body part respectively, the rail formation being defined by the second body segment of the first body part in a region disposed operatively beneath the second body part, the complementary rail and groove formations extending between the heel and toe of the golf club head.

5. A golf club head as claimed in claim 1, in which the heel end of the first body part is profiled to cooperate with a cut-back formation on the second body part for locating the two body parts in their required configuration in the heel end of the golf club head.

6. A golf club head as claimed in claim 1, in which the frame and the first body part define abutting faces and the abutting faces define complementary formations whereby these faces are located with respect to one another.

7. A golf club head as claimed in claim 1, in which the first body segment of the first body part defining the striking face of the golf club head is a substantially flat planar body segment and the second body segment defining the sole of the golf club head extends substantially perpendicularly from the first body segment.

8. A golf club head as claimed in claim 1, in which the securing means includes at least one rivet and the first and second body parts define aligned apertures therein in which the rivet is received.

9. A golf club head as claimed in claim 1, in which the securing means includes at least one locking screw and the first and second body parts define aligned apertures in which the locking screw is received, the first and second body parts being secured together by the locking screw.

10. A golf club head as claimed in claim 1, in which an adhesive acts between abutting faces of the first and second body parts.

11. A golf club head as claimed in claim 10, in which channel-shaped recesses are defined in the abutting face of at least one of the first and second body parts, within which the adhesive is collected.

12. A golf club head as claimed in claim 10, in which the adhesive is a silicone-type adhesive forming a resiliently compressible layer of material between the first and second body parts.

13. A golf club head as claimed in claim 1, in which the striking face defined by the first body segment of the first body part defines a series of parallel grooves therein that are substantially horizontally disposed in the operative configuration of the golf club head for striking a golf ball.

14. A golf club head as claimed in claim 1, in which the second body part is of a material comprising stainless steel.

15. A golf club head as claimed in claim 1, in which the first body part is of a material that provides for predetermined striking characteristics of the golf club head.

16. A golf club head as claimed in claim 15, in which the first body part is formed of any one of the following range of materials: graphite, beryllium copper, aluminium bronze, forged steel, cast stainless steel, and a combination of these materials.

17. A golf club which includes a golf club head as claimed in claim 1 and a golf club shaft secured to the socket formation of the second body part of the golf club head.

18. An assembly for a head of a golf club iron, said head having a striking face, a sole, and a socket formation, said assembly comprising:

a) a first body part including a first body segment and a second body segment extending integrally from the first body segment;

b) a second body part including a frame and the socket formation, said socket formation extending integrally from the frame, said first and second body parts being detachably secured to one another to form said head with the assembly in an assembled configuration, said first body segment defining the striking face of the head and said second body segment defining the sole of the head with the assembly in the assembled configuration, said frame being perimeter weighted around a central region thereof such that the frame provides perimeter weighting operatively behind the striking face with the assembly in the assembled configuration; and c) cooperating first and second securing means on said first and second body parts respectively for detachably securing said first body part to said second body part in said assembled configuration and for permitting displacement of the first body part with respect to the second body part only along a line substantially parallel to the sole of the golf club head and in a direction away from the socket formation of the second body part.

19. An assembly as claimed in claim 18 wherein said assembly further comprises a replacement first body part including a replacement first body segment and a replacement second body segment extending integrally from the replacement first body segment, said replacement first body part and said second body part being detachably secured to one another to form a replacement head when the assembly is in a replacement configuration, said replacement first body segment providing the replacement head with a replacement striking face and said replacement second body segment providing the replacement head with a replacement sole when the assembly is in the replacement configuration, said replacement first body part comprising replacement securing means cooperating with said second securing means for detachably securing said replacement first body part to said second body part in said replacement configuration and for permitting displacement of the replacement first body part with respect to the second body part only along a line substantially parallel to a replacement sole of the replacement head and in a direction away from the socket formation of the second body part.

20. An assembly as claimed in claim 19 wherein the striking face defined by the first body segment forms a first angle with respect to the sole of the head with the assembly in the assembled configuration, and wherein the replacement striking face defined by the replacement first body segment forms a second angle with respect to the replacement sole of the replacement head with the assembly in the replacement configuration, said first and second angles being different.

21. An assembly as claimed in claim 18 wherein said assembly further comprises a replacement second body part including a replacement frame and a replacement socket formation extending integrally from the replacement frame, said first body part and said replacement second body part being detachably secured to one another to form a second replacement head when the assembly is in a second replacement configuration, said replacement second body part comprising second replacement securing means cooperative with said first securing means for detachably securing said first body part to said replacement second body part in said second replacement configuration and for permitting displacement of the first body part with respect to the replacement second body part only along a line substantially parallel to the sole of the second replacement head and in a direction away from the replacement socket formation of the replacement second body part.

* * * * *